US008583022B2

(12) United States Patent
Watanabe et al.

(10) Patent No.: US 8,583,022 B2
(45) Date of Patent: Nov. 12, 2013

(54) LUBRICANT COATING DEVICE AND IMAGE FORMING APPARATUS INCORPORATING THE LUBRICANT COATING DEVICE

(75) Inventors: Yohhei Watanabe, Kanagawa (JP); Tsutomu Katoh, Kanagawa (JP); Hajime Teraji, Kanagawa (JP); Yoshihisa Watanabe, Kanagawa (JP); Arinobu Yoshiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 13/047,373

(22) Filed: Mar. 14, 2011

(65) Prior Publication Data

US 2011/0222938 A1 Sep. 15, 2011

(30) Foreign Application Priority Data

Mar. 15, 2010 (JP) ..... 2010-058478

(51) Int. Cl.
*G03G 21/00* (2006.01)

(52) U.S. Cl.
USPC ..... 399/346; 399/343

(58) Field of Classification Search
USPC ..... 399/346
See application file for complete search history.

(56) References Cited

U.S. PATENT DOCUMENTS

| | | | | |
|---|---|---|---|---|
| 5,950,062 | A | 9/1999 | Yahata et al. | |
| 7,158,730 | B2 | 1/2007 | Watanabe et al. | |
| 7,274,897 | B2 | 9/2007 | Katoh | |
| 7,302,208 | B2 | 11/2007 | Tsuda et al. | |
| 7,493,061 | B2 | 2/2009 | Hatori et al. | |
| 7,499,665 | B2 | 3/2009 | Kuma et al. | |
| 7,509,073 | B2 | 3/2009 | Katoh et al. | |
| 7,522,850 | B2 | 4/2009 | Watanabe et al. | |
| 7,609,998 | B2 | 10/2009 | Katoh et al. | |
| 7,627,268 | B2 | 12/2009 | Katoh et al. | |
| 7,848,692 | B2 | 12/2010 | Saeki et al. | |
| 7,885,588 | B2 | 2/2011 | Katoh et al. | |
| 7,899,386 | B2 | 3/2011 | Saeki et al. | |
| 2004/0136757 | A1* | 7/2004 | Sawai | 399/297 |
| 2004/0165919 | A1* | 8/2004 | Nishida | 399/346 |
| 2006/0045570 | A1 | 3/2006 | Kato et al. | |
| 2007/0068738 | A1* | 3/2007 | Kawahara et al. | 184/99 |
| 2007/0127947 | A1 | 6/2007 | Kuma et al. | |
| 2007/0183824 | A1* | 8/2007 | Suda et al. | 399/346 |
| 2007/0231029 | A1* | 10/2007 | Konno | 399/346 |
| 2007/0248391 | A1 | 10/2007 | Yokokawa et al. | |
| 2008/0145102 | A1 | 6/2008 | Katoh et al. | |
| 2009/0169236 | A1 | 7/2009 | Fukao et al. | |
| 2009/0279906 | A1 | 11/2009 | Kuma et al. | |
| 2009/0317104 | A1 | 12/2009 | Katoh et al. | |
| 2010/0040386 | A1 | 2/2010 | Mizutani et al. | |
| 2010/0061752 | A1 | 3/2010 | Sudo et al. | |

FOREIGN PATENT DOCUMENTS

| | | |
|---|---|---|
| JP | 2000-19858 | 1/2000 |
| JP | 2001-305907 | 11/2001 |
| JP | 2007-293240 | 11/2007 |

* cited by examiner

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

A lubricant supplying device comprises a solid lubricant, a lubricant applicator to scrape and supply the lubricant to a target, and a pressing mechanism to press the solid lubricant against the lubricant applicator. An amount of pressure applied to the solid lubricant by the pressing mechanism increases until one of a thickness of the solid lubricant and a number of printed sheets reaches a prescribed level after the lubricant starts being consumed.

12 Claims, 5 Drawing Sheets

Te<Ts, Xe<Xs, Ys<Ye

LUBRICANT COATING DEVICE AND IMAGE FORMING APPARATUS INCORPORATING THE LUBRICANT COATING DEVICE

CROSS REFERENCE TO RELATED APPLICATIONS

This application claims priority pursuant to 35 USC §119 to Japanese Patent Application No. 2010-058478, filed on Mar. 15, 2010, the entire contents of which are herein incorporated by reference.

BACKGROUND OF THE INVENTION

1. Field of the Invention

The present invention relates to a lubricant coating device and an image forming apparatus, and in particular, to a lubricant supplying mechanism disposed in a lubricant coating device and an image forming apparatus.

2. Description of the Background Art

As is well know, in an image forming apparatus, such as a copier, a printer, a duplicator, etc., there is provided a lubricant supply system that supplies lubricant to a photoconductive member and an intermediate transfer belt to decrease a friction resistance generally caused during a cleaning process for cleaning the photoconductive member and the intermediate transfer belt after an image transfer process in order to prevent a porous image from being transferred therefrom in a transfer process as described in Japanese Patent Application Laid Open No. 2001-305907 (JP-2001-305907-A).

Such lubricant is scraped and supplied to the photoconductive member and/or the transfer belt by a supplying brush in rotary contact therewith. However, when the lubricant is consumed and a thickness thereof decreases, a contact condition of the supplying brush in contact with the lubricant becomes unstable, and a supplying amount thereof possibly becomes unsteady as well.

To avoid, such a problem, a prescribed system can be employed, in which a pair of elastic members, such as springs, etc., press the lubricant at both its lengthwise ends, respectively, toward the supplying brush with its axis aligned with a normal line of the supplying brush.

However, an elastic force possibly decreases as the lubricant is consumed in proportion to an expansion amount of the spring. In addition, when an abrasion amount of the lubricant is different between the lengthwise ends, supplying amount therefrom is also different from each other.

To avoid such a problem, the applicant has proposed a system capable of uniformly supplying a prescribed amount of lubricant from the entire lengthwise portion thereof as described in Japanese Patent Application Laid Open No. 2007-293240 (JP-2007-293240-A), which is submitted as IDS. Therefore, the description of the system is herein incorporated by reference.

However, it is realized that avoiding deterioration of a supplying brush as time elapses is important to maintain a preferable contact condition of the lubricant in contact with the supplying brush.

Because, when the supplying brush scrapes off the lubricant by friction therebetween and supplies it to a target, bristles of the brush sometimes deform and flattened due to the friction resistance as time elapses.

Nor can this problem be solved simply by maintaining the pressure of the lubricant against the supplying brush at a prescribed constant level using the above-described technology. Thus, for example, when the supplying brush bites hard into the lubricant, the bristles of the brush tend to flattened more. As a result, the amount of lubricant to be supplied possibly largely decreases. To minimize such flattering and deformation, the invasion amount can be decreased. However, because the contact condition of the brush in contact with the lubricant becomes unstable at light pressure because the brush is not perfectly round, lubricant supply becomes unstable.

SUMMARY OF THE PRESENT INVENTION

Accordingly, an object of the present invention is to address and resolve such and other problems and provide a new and novel lubricant supplying device that comprises a solid lubricant, a lubricant applicator to scrape and supply the lubricant to a target, and a pressing mechanism to press the solid lubricant against the lubricant applicator. An amount of pressure applied to the solid lubricant by the pressing mechanism increases until one of a thickness of the solid lubricant and a number of printed sheets reaches a prescribed level after the lubricant starts being consumed.

The pressing mechanism includes a bias device to provide a bias, and plural pressing members to receive the bias from the bias device and symmetrically press the solid lubricant at two positions thereof about a contact center in a prescribed pressing direction. A direction of the bias is perpendicular to the prescribed pressing direction. Each of the plural pressing members has a fulcrum and is freely swingable therearound. An angle formed by an extension line extending through an operation point and the fulcrum provided in each of the plural pressing members and the prescribed pressing direction decreases while an angle formed by an extension line extending through a power point and the fulcrum provided in each of the plural pressing members and the prescribed biasing direction increases as the solid lubricant is scraped and an amount thereof decreases. The operation point contacts a base of the lubricant supplying device via its contact section and the power point receives the bias of the bias device.

In yet another aspect, the power point is located to meet the following inequation when "A" is calculated by the following equality;

$$Ae/As > Fs/Fe,$$

and $$\text{“}A\text{”} = (X \times Y)/L^2,$$

wherein X represents a horizontal distance between the operation point and the fulcrum, Y represents a vertical distance between the power point and the fulcrum, L represents a distance between the operation point and the fulcrum, F represents a bias force of the bias device, and suffixes "s" and "e" represent initial and final values, respectively.

In yet another aspect, the contact section of the pressing member is one of point and area contact sections.

In yet another aspect, the contact section of the pressing member has a circular shape.

In yet another aspect, plural pressing members press the target via a lubricant holder.

In yet another aspect, the lubricant applicator is a brush.

In yet another aspect, the pressing mechanism is enabled to press the solid lubricant so that an invasion amount thereof into the brush is about 10% and more of a natural length of a bristles of the brush.

In yet another aspect, a leveling member is provided to contact a surface of the target and level the solid lubricant when the lubricant is supplied thereon.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
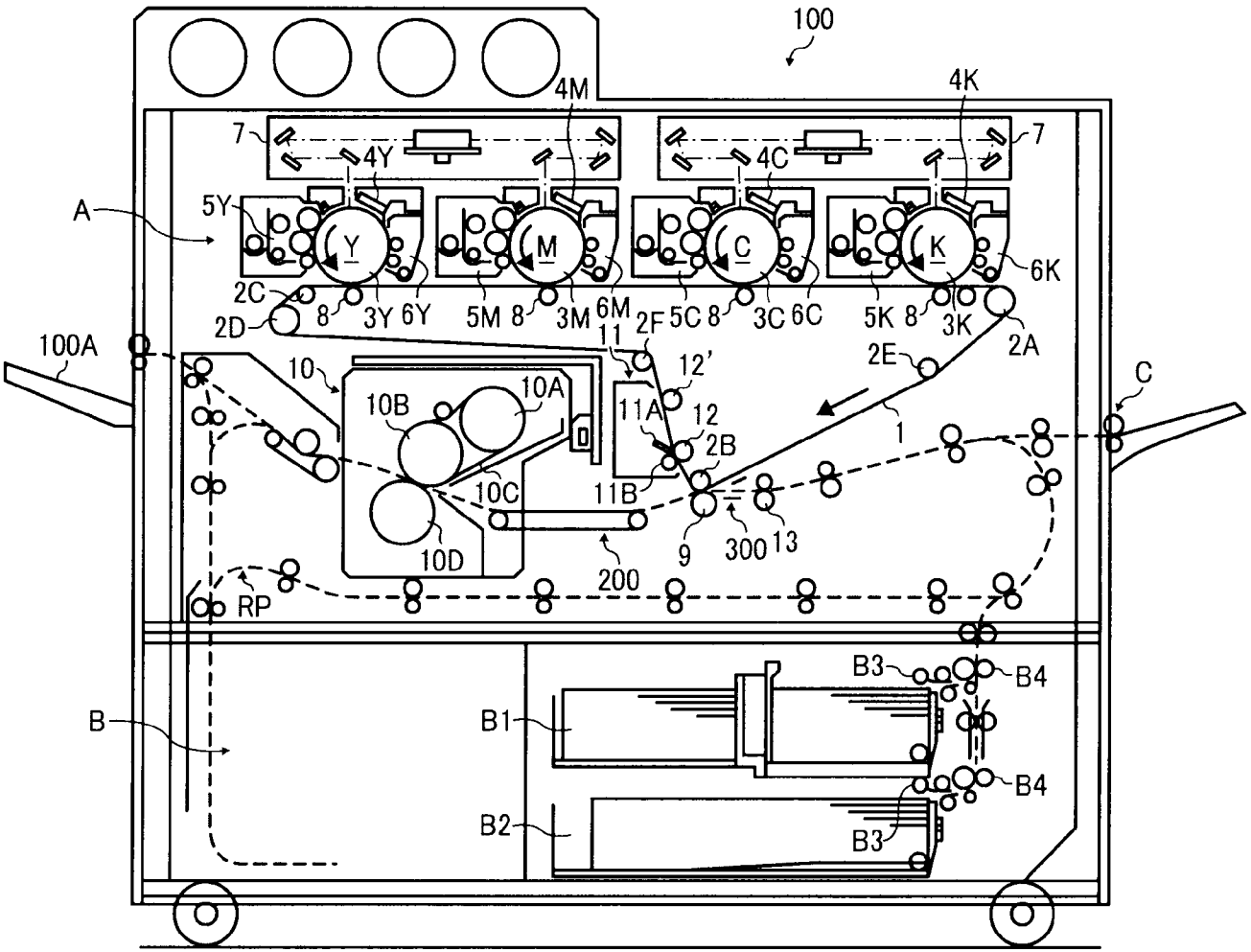
FIG. 1 illustrates a configuration of an image forming apparatus that employs an exemplary lubricant coating device according to one embodiment of the present invention.

Referring now to the drawing, wherein like reference numerals designate identical or corresponding parts throughout several views, in particular, in FIG. 1, a configuration of an image forming apparatus according to one embodiment of the present invention is described. As shown, an image forming apparatus 100 is a tandem type that includes an endless intermediate transfer belt serving as an image bearer capable of bearing a toner image thereon and plural image formation stations arranged side by side along a stretching surface of the intermediate transfer belt. Below an image formation section A in the image forming apparatus 100, there is provided a sheet feeding bank B accommodating sheets serving as a recording medium.

In an image formation section A, there is provided an intermediate transfer belt 1, which is wound around plural rollers 2A to 2F and is conveyed by the driving roller 2A In a direction shown by an arrow in the drawing. A stretching surface of the intermediate transfer belt 1 is partially bent to an inner circumferential surface side thereof by the roller 2F to create a space for disposing a below described fixing device 10, so that the height of the image forming apparatus is decreased. Plural image formation stations capable of respectively forming different color images are arranged side by side facing one of the stretching surfaces of the intermediate transfer belt 1.

The respective image forming stations have substantially the same configuration as others, and the black color image forming station K is typically described hereinafter. There is provided a rotatable photoconductive drum 3 in the image forming station. Around the photoconductive drum 3, a charger 4, a developing device 5, and a cleaner 6 are arranged collectively constituting a process cartridge.

Above the image forming stations, there is disposed a writing device 7 including a laser source for emitting a writing light to the photoconductive drum 3 in accordance with image information via an optical system. At positions opposing the photo-conductive drums 3 via the intermediate transfer belt 1 in the respective image forming stations, there are provided primary transfer rollers 8 as a primary transfer device.

A secondary transfer roller 9 as a secondary transfer member is disposed downstream of the image forming station opposing a transfer backside roller 2B via the intermediate transfer belt 1. The secondary transfer roller 9 transfers an image superimposed on the intermediate transfer belt at once onto a sheet launched from the sheet feeding bank B. The fixing device 10 is disposed downstream of the secondary transfer roller 9 to fix a toner image onto the transfer member conveyed there by a below described conveyance device 200.

The fixing device 10 is a belt type including a heating roller 10A, a fixing roller 10B, a fixing belt 10C wound around the heating roller 10A and the fixing roller 10B, and a pressing roller 10D opposing the fixing roller 10B. Since calorie of a belt is small, a warm up time reaching a prescribed temperature is decreased. During pinching and conveying the transfer member between the fixing and pressing rollers 10B and 10D in the fixing device 10, heat and pressure is applied thereto, so that the toner image bored thereon is fused and penetrates thereby being fixed.

The transfer member having been subjected to the fixing process is conveyed toward a sheet ejection tray 100A disposed at an outside of the image forming apparatus or toward a reversion conveyance device RP to execute duplex copying.

Toner and alien substance, such as sheet dust, etc., remaining on the intermediate transfer belt 1 are removed by a belt cleaner 11 disposed in the vicinity of the bending section. The belt cleaner 11 of a configuration shown FIG. 1 includes one of a cleaning blade 11A, a roller, and a brush roller contacting the intermediate transfer belt 1. A backup roller 12 is disposed on the inner circumferential surface side of the intermediate transfer belt 1 opposing the cleaner to expedite scraping efficiency of the cleaner scraping the alien substance.

Plural sheet feeding cassettes B1 and B2 are provided in the sheet feeding bank B each including a launching roller B3 and a sheet feeding roller B4 on the transfer member launching side therein. On the conveyance path for conveying the transfer member launched from the sheet feeding cassettes B1 and B2, there is provided a registration roller 13 upstream of a secondary transfer section where a secondary transfer roller is disposed, so that the registration roller can launch the transfer member at a prescribed registration time to synchronize with an image position. Back to FIG. 1, C denotes a manual sheet feeding section. A conveyance path connected to the manual sheet feeding section C meets a conveyance path coming from the sheet feeding bank upstream of the registration roller 13.

In the image forming apparatus 100 with such a configuration, when the photoconductive drum 3 is uniformly charged by the charger 4 and a writing light is emitted from the writing device 7, a latent image is formed in the image forming station. Subsequently, toner supplied from the developing device 5 visualizes the latent image and generates a toner image.

The toner image born on the photoconductive drum 3 is transferred onto the intermediate transfer belt using a transfer bias provided by the primary transfer roller 8. A toner image generated by superimposing respective images in the image forming stations is transferred at once by the secondary transfer roller 9 onto a transfer member launched from the sheet feeding bank B. The transfer member having completed the secondary transfer process is then conveyed toward the fixing device 10 by a later described conveyance device 200. Subsequently, the toner image on the transfer member is fixed by the fixing device 10 and is then conveyed toward either the sheet ejection tray 100A or the reversion conveyance device RP.

Completing the primary transfer process, the photoconductive drum 3 and intermediate transfer belt 1 are subjected to cleaning processes of the cleaners 6 and 10 disposed in the image forming station and the belt bending section, respectively, to prepare for the next image formation.

Figure 2:
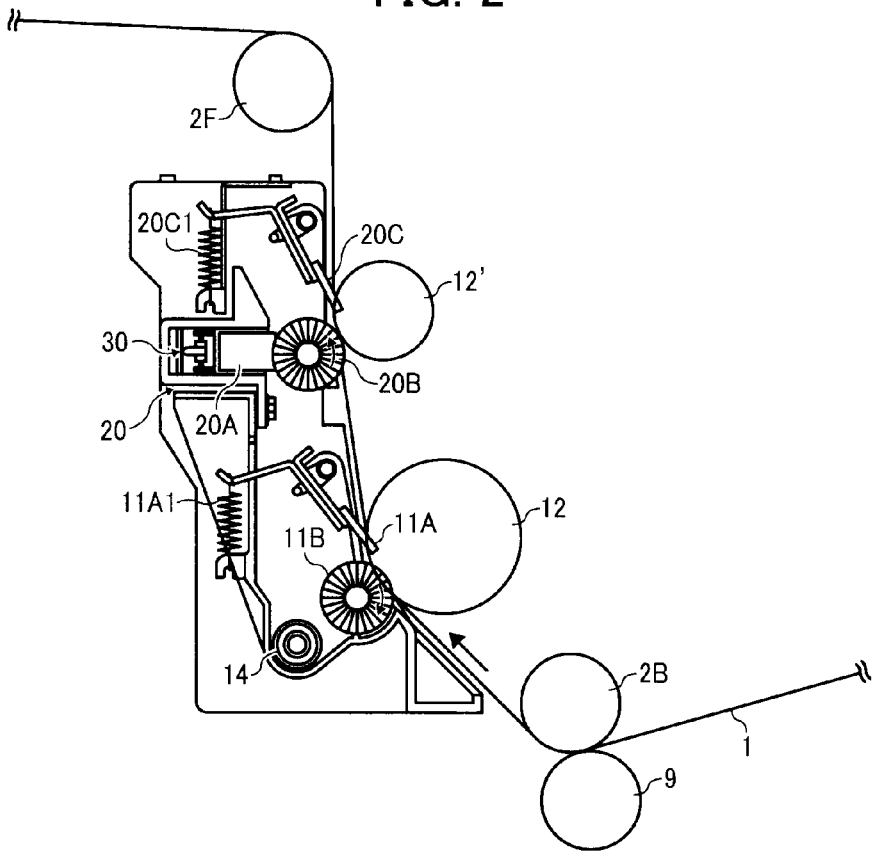
FIG. 2 illustrates a configuration of a cleaner for executing cleaning of a transfer belt provided in an image forming apparatus using an exemplary lubricant coating device according to one embodiment of the present invention.

Now, an exemplary configuration of the cleaner for the intermediate transfer belt 1 is more specifically described with reference to FIG. 2. As described with reference to FIG. 1, the cleaner 11 is disposed opposing the intermediate transfer belt 1 downstream of the secondary transfer roller 9 in a moving direction of the intermediate transfer belt as shown by an arrow in FIG. 2.

In the cleaner 11, an inlet seal 11C preventing scattering of toner therefrom, a cleaning blade 11A, and a brush roller 11*b* are disposed on the upstream side therein in the intermediate transfer belt moving direction. The brushing roller 11B is enabled to rotate counter to a moving direction of the intermediate transfer belt 1 to remove pre-transferred toner or alien substance, such as sheet dust, etc., sticking thereto in cooperation with a cleaning blade that is given tendency of contacting the intermediate transfer belt 1 by the pressing spring 22A. In the drawing, 14 denotes a waste toner conveyance coil to eject waste toner to an outside of the cleaner.

A lubricant supplying device 20 is disposed on the downstream side of the intermediate transfer belt 1 in the cleaner 11. The lubricant supplying device 20 includes a solid lubricant 20A, a supplying brush roller 20B including a bristles state rotator that rotates in a direction shown by an arrow and scrapes and coats the intermediate transfer belt 1 with the solid lubricant contacting the solid lubricant 20A. Also included are a leveling cleaning blade 20C that contacts the intermediate transfer belt to level and form a thin lubricant layer thereon, and a pressing spring 20C1 that provides tendency of contacting the intermediate transfer belt 1 to the leveling cleaning blade 20C. At opposing sections to the above-described brush rollers 11B and 20B via the intermediate transfer belt 1, cleaning opposing rollers 12 and 12' are disposed as backside pressure members.

The brush roller 20B is made of PET bristles having fineness of about 200 T (deci Tex) to supply the solid lubricant 20B to the surface of the intermediate transfer belt 1. If the brush fineness is too high, rigidity thereof becomes too strong to obtain a sufficient amount of invasion thereof capable of absorbing fluctuation of a pressing force. Further, it is not preferable for a surface performance of a cleaning target if high rigidity brush bristles slide and contact the cleaning target. By contrast, when the brush fineness is too low, the lubricant excessively bites into the brush roller and flatten and deforms a brush. In this point of view, the brush fineness is preferably from about 100 to about 300 T.

The solid lubricant 20A is biased against the brushing roller 20B by a bias of the pressing spring employed in a later described pressing mechanism. The solid lubricant 20A is made of fatty acid metal salt. The metal can be selected from zinc, iron, calcium, aluminum, lithium, magnesium, strontium, barium, cerium, titan, zirconium, lead, and manganese or the like. The fatty acid salt is selected from at least one of lauryl acid, stearic acid, palmitic acid, mysterium acid, and oleic acid or the like. Especially, zinc stearate and calcium stearate are more effective in view of friction reduction on an image bearer.

Now, the pressing mechanism 30 for pressing the solid lubricant 20A is more specifically described with reference to FIG. 3, wherein only a left half thereof is illustrated because of its symmetric shape. As shown, a holder 31 holds the solid lubricant 20A and includes a swinging fulcrum? around which the pressing member 32 made of polyacetal having a fine sliding performance swings.

Thus, the two pressing members 32 are symmetrically arranged in the vicinity of both ends of the lubricant 20A about its lengthwise center, and are enabled to swing around supporting pins 31A disposed on the holder 31, respectively. The pressing member 32 includes a hook section 32A between a base end having the supporting pin 31A and its swinging end. A pressing spring 33 is hooked by the hook sections 32A of the respective pressing members symmetrically arranged to pull these pressing members as described in Japanese Patent Application Laid Open No. 2007-293240 (JP-2007-293240-A) by the applicant, the description of which is incorporated herein.

Now, an exemplary characteristic configuration of a system in which a pressing member 32 presses a solid lubricant via a holder 31 that holds the lubricant 20A is more specifically described.

As described below, one embodiment of the present invention is characterized in that an operation force N used as a pressing force is not maintained constant, but is increased until a thickness of the lubricant 20A or a number of printed sheets reach a prescribed level from when the lubricant 20A starts being consumed. More specifically, the hook section 32A is positioned at a prescribed location where an angle formed by an extension line that extends through an operation point generating an operation force and the fulcrum of the pressing member 32 and the pressing direction of the solid lubricant 20A decreases, while an angle formed by an extension line that extends through a power point receiving the bias of the pressing spring 33 and the fulcrum of the pressing member 32 and the biasing direction of the pressing spring 33 increases in accordance with decrease in thickness of the lubricant 20A as a result of consumption thereof.

According to a characteristic configuration of one embodiment of the present invention, the pressing member 32 has a circular arc shape at its swinging side end contacting a surface of a container casing 34 to receive a reaction force from the container casing 34 when contacting thereto to use it as an operation force N applied to the lubricant 20A. Further, the lubricant 20A is pressed by the pressing member 32 and contacts the brush bristles with the operation force N to create a bent of about 1 mm of the brush bristles when its natural length is about 5 mm.

Now, a change of an operation force N in accordance with changes of the power and operation points of the pressing member 32 is typically described with reference to FIG. 5. As shown, the operation force N is calculated by the following formula based on a balance of moments caused by distances from the fulcrum to the power and operation points;

$$N=(1/NL)F \sin \phi \cos \theta$$

When considering that the distances from the fulcrum, which are parameters of the moments when the pressing member 32 swings, are represented by the following first two equations, the above-described operation force N is sought by the following second equation;

$$L \sin \phi = Y, \cos \theta = X/L,$$

and $$N = F \cdot (X \cdot Y)/L^2.$$

That is, an angle formed by an extension line that extends through an operation point and the fulcrum of the pressing member 32 and the pressing direction of the solid lubricant 20A decreases, while an angle formed by an extension line that extends through a power point receiving the bias of the pressing spring 33 and the fulcrum of the pressing member 32 and the biasing direction of the pressing spring 33 increases, when the pressing member 32 swings sliding on the container casing 34 in accordance with a change in thickness of the lubricant 20A as a result of consumption thereof.

Figure 3:
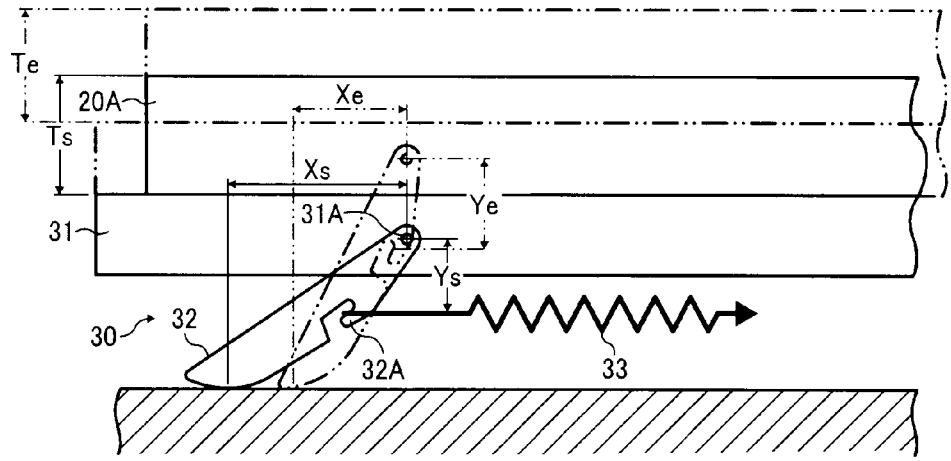
FIG. 3 illustrates an exemplary pressing mechanism employed in the cleaner of FIG. 2.
Figure 4:
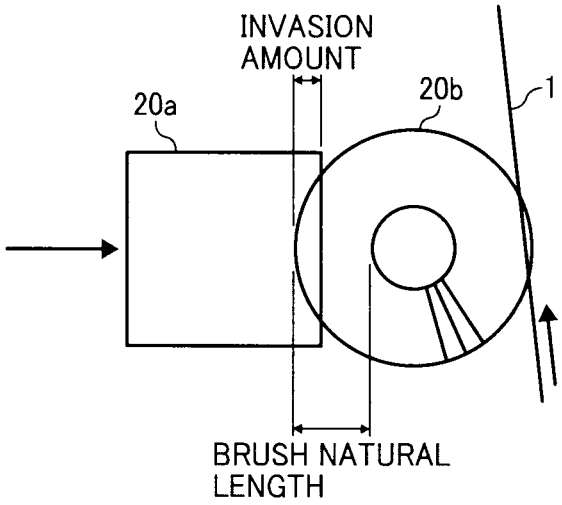
FIG. 4 typically illustrates an amount of invasion of an applicator into the lubricant.
Figure 5:
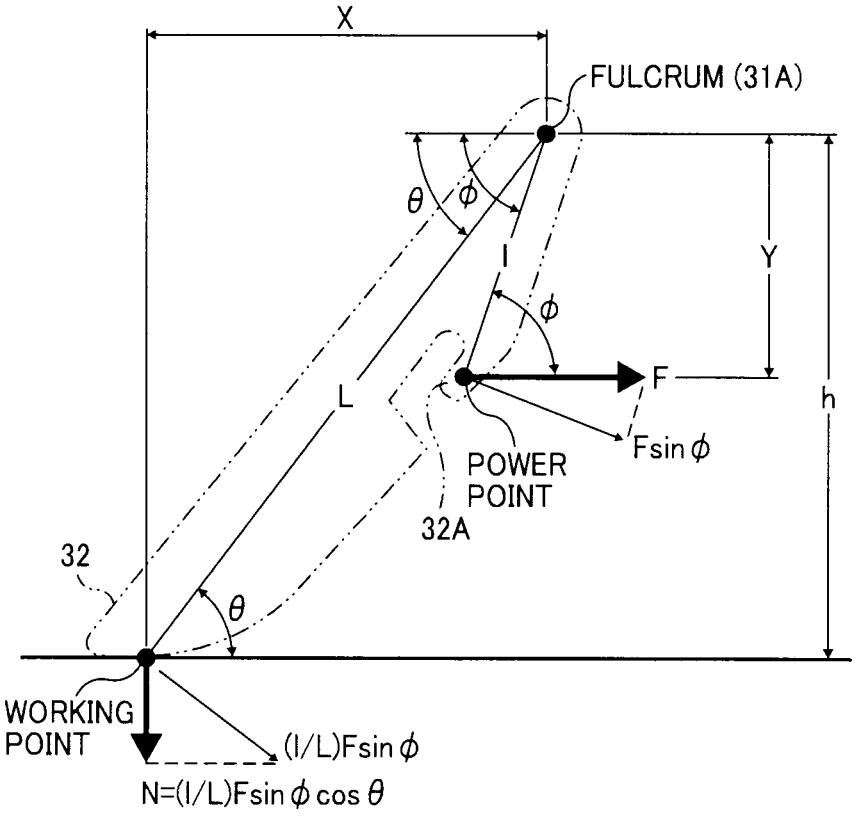
FIG. 5 typically illustrates an exemplary dynamic model related to pressure utilized in the pressing mechanism of FIG. 3.

In one embodiment of the present invention, to increase the operation force N in accordance with consumption amount of the solid lubricant 20A from initial consumption stage to a terminating consumption stage in accordance with a change in angle of the pressing member 32 during its swinging?, the hook 31A is positioned at a prescribed location on the pressing member 32 to meet the following inequation as shown in FIGS. 3 and 5 when "A" is represented by the following equality;

$$Ae/As > Fs/Fe,$$

$$\text{“}A\text{”} = (X \times Y)/L^2$$

wherein X represents a horizontal distance between the operation point and the fulcrum, Y represents a vertical distance between the power point and the fulcrum, L represents a distance between the operation point and the fulcrum, F represents a bias force of the bias device, and suffixes "s" and "e" represent initial and time elapsing values, respectively. Further, Ts represents a thickness of the solid lubricant 20A at its initial usage stage, where as Te represents that at its consumption terminating stage, wherein the below described relation is established.

$$Ts > Te$$

Figure 6:
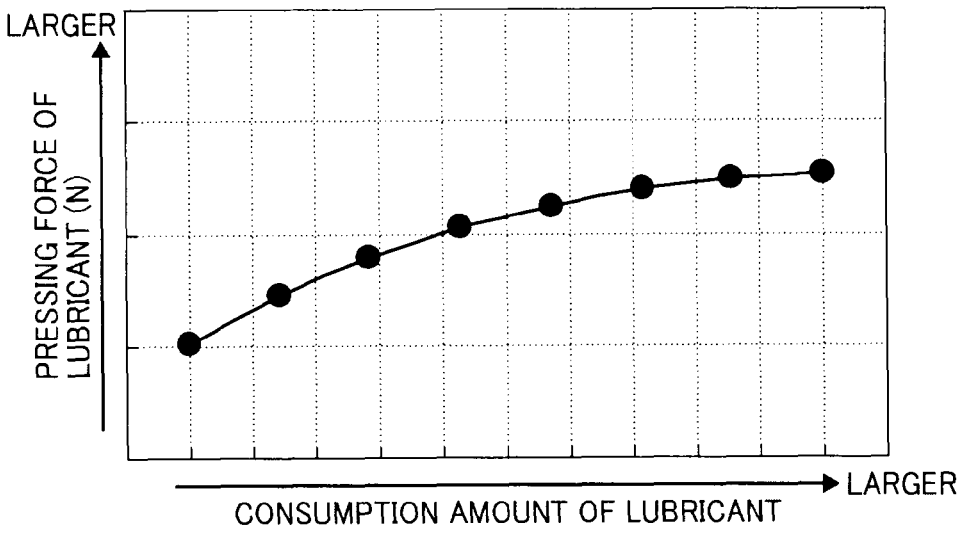
FIG. 6 typically illustrates an exemplary relation between pressure against the lubricant in the dynamic model of FIG. 5 and an amount of consumption thereof.
Figure 7:
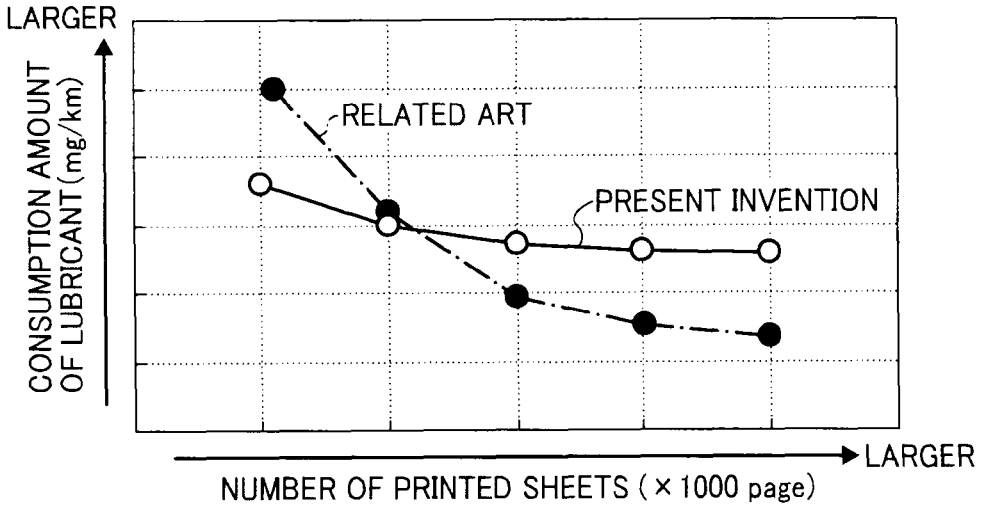
FIG. 7 typically illustrates an exemplary relation between relations between an amount of consumption of the lubricant and a number of printed sheets in a comparative example and one of the embodiments of the present invention.

An exemplary condition of an increase in operation force caused by swinging movement of the pressing member 32 in the pressing mechanism 30 in accordance with a consumption amount of the solid lubricant 20A is illustrated in FIG. 6.

As shown, when it is controlled to maintain a prescribed operation force, an amount of consumption of the solid lubricant 20A gradually decreases. By contrast, an amount of consumption of the solid lubricant 20A does not decrease very much in one embodiment of the present invention, because the operation force is gradually increased.

Specifically, according to one embodiment of the present invention, the above-described configuration is employed to intentionally avoid deterioration of contact of the brushing roller 20B in contact with the solid lubricant 20 by supposing that tips of the bristles of the brushing roller 20B are flattened and causes the deterioration as time elapses.

As a result, regardless of the flattering of the above-described brush hair, an amount of solid lubricant 20A does not decrease.

Further, about 1.5 N is designated as an operation force in the consumption initial stage, i.e., an initial contact pressure of the brushing roller 20B in contact with the solid lubricant 20A, and about 2 N is designated as an operation force in the consumption final stage. In this situation, about 150 mg/Km, more preferably 100 mg/Km to 200 mg/Km, is designated as a consumption amount of the solid lubricant 20A per unit running length of the intermediate transfer belt 1 as a cleaning objective to avoid transfer and cleaning malfunctions in the secondary transfer section and the cleaner, respectively, due to increase in a friction coefficient.

Figure 8:
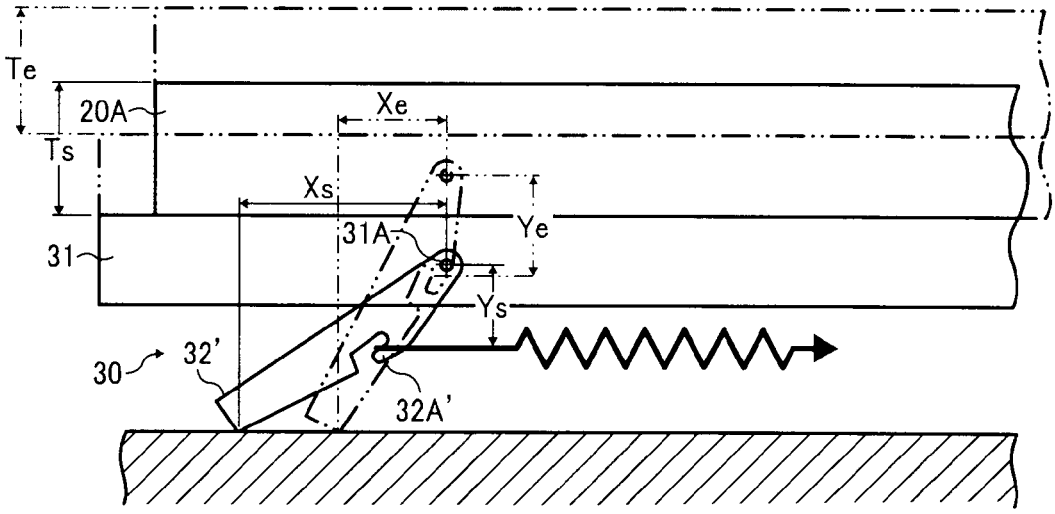
FIG. 8 illustrates an exemplary partial modification of the pressing mechanism of FIG. 3.

Instead of the above-described circular arc shape 2, the swinging side end of the pressing member 3 can be area and point shapes as far as they can receive an operation force of a bias from the pressing spring 33. For example, the side end shape having a corner can be exemplified even if X and Y distance values from the fulcrum slightly fluctuate as shown in FIG. 8.

Further, the lubricant supplying mechanism in the various embodiments can be applied to an image bearer, such as a photoconductive member, etc., in addition to the intermediate transfer belt as a cleaning target. In such a situation, it is preferable that a ratio of pressure increase of the pressing member is greater than when the photoconductive member is targeted that when the intermediate transfer belt is targeted for the reason as described below.

Figure 9:
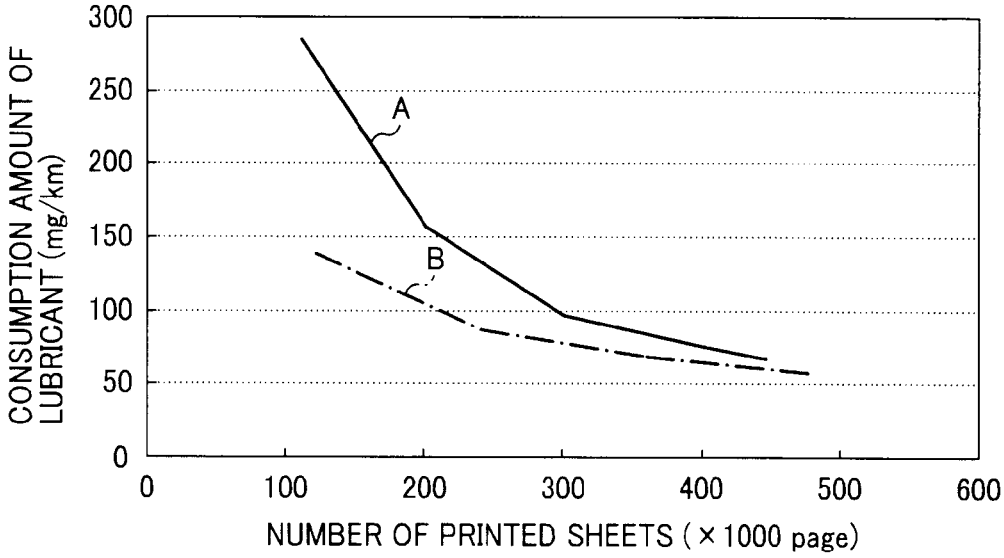
FIG. 9 is a chart typically illustrating an exemplary relation between a biasing force of a pressing spring employed in the pressing mechanism and an amount of consumption of the lubricant.

That is, when a toner image is transferred from the image bearer onto the intermediate transfer belt and a surface friction coefficient of the photoconductive member is higher than that of the intermediate transfer belt, a porous image is transferred in the transfer process as described in Japanese Patent Application Laid Open No. 2000-019858. Thus, the friction coefficient of the image bearer located upstream is preferably kept smaller. Consequently, an amount of lubricant to be supplied is preferably increased in proportion to an upper level of a position of a cleaner. However, it is known that an amount of the lubricant supplied changes from the initial stage as time elapses as shown in FIG. 9.

As shown, pressure of the lubricant against the brush in the condition A is twice as large as that of the condition B, so that an amount of lubricant supplied becomes greater in the condition A. Even though a difference in supplying amount in the initial stage is prominent between the conditions A and B, which is scarcely different later from each other as time elapses. Under the condition in that the difference in supply amount is scarcely different from each other, an intended surface friction coefficient cannot be obtained depending of an operation condition, such as image area rate, a number of consecutive sheet feeding, etc., and is a friction coefficient of the intermediate transfer member is possibly lower than that of the image bearer.

Accordingly, to maintain the surface friction coefficient of the toner image bearer located upstream to be lower even as time elapses, an increasing rate of pressure of the lubricant supplying device is preferably large in proportion to an upstream level thereof from the initial stage as time elapses. Consequently, the surface friction coefficient of the image bearer located upstream can be maintained to be lower even as time elapses.

Numerous additional modifications and variations of the present invention are possible in light of the above teachings. It is therefore to be understood that within the scope of the appended claims, the present invention may be practiced otherwise that as specifically described herein.

What is claimed is:

1. A lubricant supplying device comprising:

a solid lubricant;

a lubricant applicator to scrape and supply a portion of the solid lubricant to a target; and a pressing mechanism to press the solid lubricant against the lubricant applicator, the pressing mechanism including:

a bias device to provide a bias; and at least two pressing members to receive the bias from the bias device and symmetrically press the solid lubricant at two positions thereof about a contact center in a prescribed pressing direction, wherein an amount of pressure applied to the solid lubricant by said pressing mechanism increases until a thickness of the solid lubricant or a number of printed sheets reaches a prescribed level after the solid lubricant starts being consumed, wherein a direction of said bias is perpendicular to the prescribed pressing direction, wherein each of said at least two pressing members has a fulcrum and is freely swingable therearound, wherein each of said at least two pressing members, at an operating point, contacts a base of the lubricant supplying device via its contact section, wherein each of said at least two pressing members, at a power point, receives the bias of the bias device, wherein the location of said power point satisfies the following inequation when "A" is calculated by the following equality;

$Ae/As>Fs/Fe$, and $"A"=(X\times Y)/L^2$, wherein X represents a horizontal distance between the operation point and the fulcrum, Y represents a vertical distance between the power point and the fulcrum, L represents a distance between the operation point and the fulcrum, F represents a bias force of the bias device, and suffixes "s" and "e" represent initial and final values, respectively, and wherein the inequation is satisfied such that as the solid lubricant is consumed, a pressing force applied to the solid lubricant by said pressing mechanism increases.

2. The lubricant supplying device as claimed in claim 1, wherein an angle formed by an extension line extending through the operation point and the fulcrum provided in each of the at least two pressing members and the prescribed pressing direction decreases while an angle formed by an extension line extending through the power point and the fulcrum provided in each of the at least two pressing members and the prescribed biasing direction increases as the solid lubricant is scraped and an amount thereof decreases.

3. The lubricant supplying device as claimed in claim 2, wherein said contact section of the pressing member is a point section or an area contact section.

4. The lubricant supplying device as claimed in claim 2, wherein said contact section of the pressing member has a circular shape.

5. The lubricant supplying device as claimed in claim 2, further comprising a lubricant holder, wherein said at least two pressing members press the target via the lubricant holder.

6. The lubricant supplying device as claimed in claim 1, wherein said lubricant applicator is a brush.

7. The lubricant supplying device as claimed in claim 6, wherein the brush comprises bristles and said pressing mechanism presses the solid lubricant into the brush to a depth of at least about 10% of a natural length of the bristles of the brush.

8. The lubricant supplying device as claimed in claim 2, further comprising a leveling member to contact a surface of the target and level the solid lubricant when a portion of the solid lubricant is supplied thereon.

9. An image forming apparatus, comprising:

an image bearer to bear a toner image;

an intermediate transfer member to receive the toner image;

a first transfer device to transfer the toner image onto the intermediate transfer member;

a second transfer device to transfer the toner image from the intermediate transfer member onto a sheet; and a lubricant supplying device as claimed in claim 1, wherein said lubricant supplying device supplies a portion of the solid lubricant to the image bearer.

10. An image forming apparatus, comprising:

an image bearer to bear a toner image;

an intermediate transfer member to receive the toner image;

a first transfer device to transfer the toner image onto the intermediate transfer member;

a second transfer device to transfer the toner image from the intermediate transfer member onto a sheet; and a first and a second lubricant supplying device as claimed in claim 1, wherein said first lubricant supplying device supplies a portion of the solid lubricant to the image bearer and said second lubricant supplying device supplies a portion of the solid lubricant to the intermediate transfer member.

11. A method of supplying lubricant in a printing system, comprising the steps of:

pressing a solid lubricant against an applicator with prescribed pressure via a pressing mechanism;

scraping and supplying a portion of the solid lubricant with the applicator to a target disposed in the printing system; and increasing the prescribed pressure until a thickness of the solid lubricant or a number of printed sheets reaches a prescribed level, wherein the pressing mechanism includes:

a bias device to provide a bias; and at least two pressing members to receive the bias from the bias device and symmetrically press the solid lubricant at two positions thereof about a contact center in a prescribed pressing direction, wherein a direction of said bias is perpendicular to the prescribed pressing direction, wherein each of said at least two pressing members has a fulcrum and is freely swingable therearound, wherein each of said at least two pressing members, at an operating point, contacts a base of the lubricant supplying device via its contact section, wherein each of said at least two pressing members, at a power point, receives the bias of the bias device, wherein the location of said power point satisfies the following inequation when "A" is calculated by the following equality;

$Ae/As>Fs/Fe$, and $"A"=(X\times Y)/L^2$, wherein X represents a horizontal distance between the operation point and the fulcrum, Y represents a vertical distance between the power point and the fulcrum, L represents a distance between the operation point and the fulcrum, F represents a bias force of the bias device, and suffixes "s" and "e" represent initial and final values, respectively, and wherein the inequation is satisfied such that as the solid lubricant is consumed, a pressing force applied to the solid lubricant by said pressing mechanism increases.

12. The image forming apparatus as claimed in claim 10, wherein a rate of increase of said pressure applied to the image bearer by said first lubricant supplying device is greater than a rate of increase of said pressure applied to the intermediate transfer member by said second lubricant supplying device.

* * * * *